US006220122B1

(12) United States Patent
Forsell et al.

(10) Patent No.: US 6,220,122 B1
(45) Date of Patent: Apr. 24, 2001

(54) FASTENER HOLDING TOOL AND SYSTEM

(75) Inventors: David J. Forsell, Carol Stream; Edward Douglas Yates, Chicago, both of IL (US)

(73) Assignee: Illinois Tool Works Inc, Glenview, IL (US)

( * ) Notice: Subject to any disclaimer, the term of this patent is extended or adjusted under 35 U.S.C. 154(b) by 0 days.

(21) Appl. No.: 09/421,301

(22) Filed: Oct. 20, 1999

(51) Int. Cl.[7] ..... B25C 3/00

(52) U.S. Cl. ..... 81/44; 81/64; 227/147; 279/102

(58) Field of Search ..... 81/44, 487, 64, 81/3.4, 53.1, 53.11, 53.12; 227/147; 279/102

(56) References Cited

U.S. PATENT DOCUMENTS 2,701,491 * 2/1955 Ross .
2,723,694 * 11/1955 Ross .
2,743,444 11/1956 Thomas .
2,782,822 * 2/1957 Clark .
2,929,067 3/1960 Tupta .
3,025,734 * 3/1962 Ash .
3,739,825 * 6/1973 Knox .
3,847,193 11/1974 Brunstetter .
4,403,725 9/1983 Lawrence .
4,485,701 * 12/1984 Hough .
4,691,598 * 9/1987 Lin .
4,760,763 * 8/1988 Trick et al. .
5,279,188 * 1/1994 Seeger et al. .

* cited by examiner

*Primary Examiner*—D. S. Meislin
(74) *Attorney, Agent, or Firm*—Lisa M. Soltis; Mark W. Croll; John P. O'Brien

(57) ABSTRACT

A fastener driving system and a fastener holding tool therefor having a shank and a resilient retainer with a bore therethrough coupled to a first end portion of the shank. A first end of the resilient retainer and a portion of the resilient retainer bore protrudes axially beyond the first end of the shank. In some embodiments, an annular chamfer is disposed on the resilient retainer between a first end and the bore thereof. The system includes a fastener having a shaft with a head formed on a trailing end portion thereof. The fastener head diameter is greater than the retainer bore diameter of the resilient retainer protruding axially beyond the first end of the shank to engage and retain the fastener.

10 Claims, 2 Drawing Sheets

FASTENER HOLDING TOOL AND SYSTEM

BACKGROUND OF THE INVENTION

The invention relates generally to fastener driving systems and fastener holding tools therefor.

Tools for holding a fastener while driving it into a workpiece are known generally. Fastener holding tools of this type generally retain the fastener head in a first end portion of the tool while an axial force is applied to an opposite end of the tool, either manually or with a hammering tool, to drive the fastener into the workpiece.

U.S. Pat. No. 3,847,193 entitled "Nail-Screw Holder" for example discloses a fastener holding device comprising a rigid shank with a tool engaging end and an opposite fastener retaining end having a resilient rubber-like extension coupled thereto. A fastener engaging end of the shank has a concave surface to seat the head portion of the fastener. The resilient extension has a tubular sleeve that is bonded to the fastener engaging end portion of the shank. A convex cap covering an end of the sleeve proximate the concave surface of the shank forms a pocket therebetween for receiving the fastener head, and a pair of criss-crossed slots on the cap form flaps thereon. The flaps are flexible inwardly to permit insertion of the fastener head into the pocket where it is retained prior to and during installation. Thereafter, the flaps are flexible outwardly to separate the holding device from the installed fastener.

Fastener holding tools having radially inwardly extending flexible teeth for retaining a fastener head therein, for example the flaps of the fastener holding device disclosed in the referenced U.S. Pat. No. 3,847,193 discussed above, have a tendency to deteriorate. More particularly, the flaps or teeth often become clamped or pinched between the work surface and the head of the installed fastener. The flaps or teeth are thus degraded, and in some instances tear as the tool is separated from the installed fastener. After a relatively short period of use, the flaps or teeth become ineffective for retaining the fastener.

The present invention is drawn toward advancements in the art of fastener driving systems and fastener holding tools therefor.

An object of the invention is to provide novel fastener driving systems and fastener holding tools therefor that overcome problems in the art.

Another object of the invention is to provide novel fastener driving systems and fastener holding tools that are reliable and economical.

A further object of the invention is to provide novel fastener holding tools and fastener driving systems that do not pinch or clamp a resilient fastener retainer of the holding tool between the work surface and an installed fastener.

A more particular object of the invention is to provide novel fastener holding tools comprising generally a shank and a resilient retainer having a bore through a first end portion thereof, and an annular chamfer disposed on the resilient retainer between a first end thereof and the bore. The resilient retainer is coupled to a first end portion of the shank so that the first end of the resilient retainer protrudes axially beyond a first end of the shank.

Another more particular object of the invention is to provide novel fastener driving systems comprising generally a fastener holding tool having a shank and a resilient retainer with a bore therethrough coupled to a first end portion of the shank. A first end of the resilient retainer and a portion of the resilient retainer bore protrudes axially beyond the first end of the shank. The system also comprises a fastener having a shaft with a head formed on a trailing end portion thereof An axial dimension of the fastener head is not substantially less and is preferably about the same as or greater than an axial dimension between the first end of the shank and the first end of the resilient retainer. Also, the fastener head diameter is greater than the retainer bore diameter protruding axially beyond the first end of the shank.

Yet another more particular object of the invention is to provide novel fastener driving systems comprising generally a fastener holding tool having a shank and a resilient retainer with a bore therethrough coupled to a first end portion of the shank. A first end of the resilient retainer and a portion of the resilient retainer bore protrudes axially beyond the first end of the shank. An annular chamfer is disposed on the resilient retainer between a first end thereof and the bore. The system also comprises a fastener having a shaft with a head formed on a trailing end portion thereof. An axial dimension of the fastener head is less than an axial dimension between the first end of the shank and the first end of the resilient retainer so that the first end of the resilient retainer extends axially beyond a bottom end of the fastener head retained in the retainer bore. The fastener head diameter is greater than the retainer bore diameter protruding axially beyond the first end of the shank to engage and retain the fastener.

These and other objects, aspects, features and advantages of the present invention will become more fully apparent upon careful consideration of the following Detailed Description of the Invention and the accompanying Drawings, which may be disproportionate for ease of understanding, wherein like structure and steps are referenced generally by corresponding numerals and indicators.

DETAILED DESCRIPTION OF THE INVENTION

Figure 1:
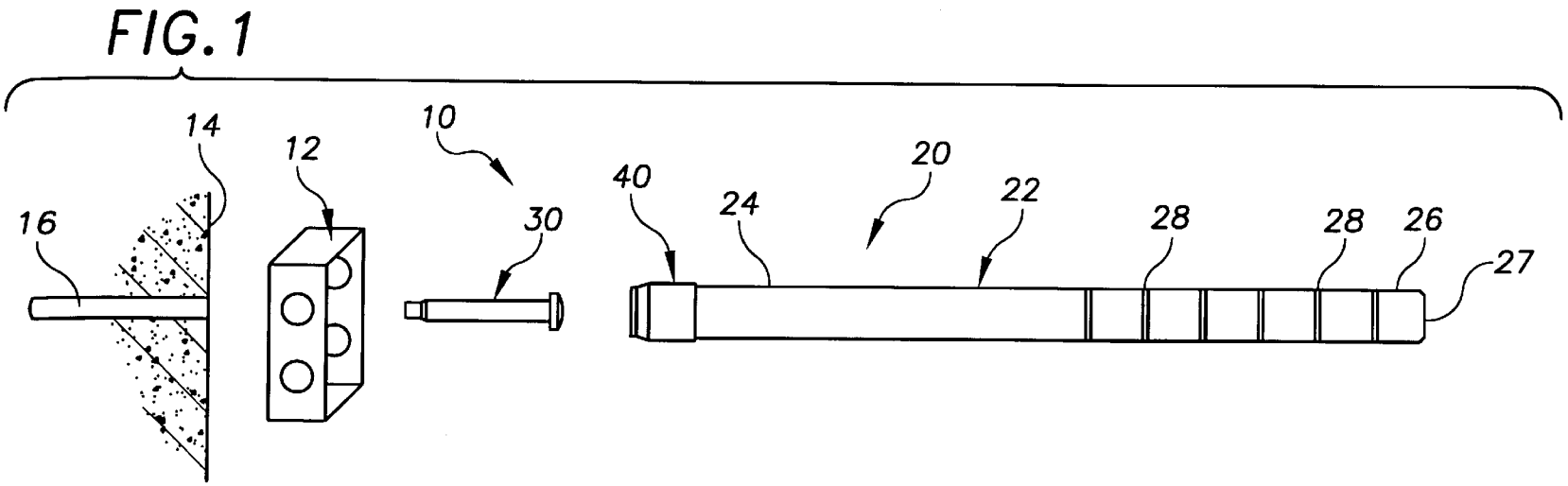
FIG. 1 illustrates a fastener driving system according to an exemplary embodiment of the invention used in an exemplary concrete fastening application.

FIG. 1 illustrates a fastener driving system 10 according to an exemplary embodiment of the invention comprising generally a fastener holding tool 20, referred to herein sometimes as a holding or driving tool, and a fastener 30.

The fastener holding tool comprises a shank in the exemplary form of a generally cylindrical rod 22 having a first end portion 24 with a first end and a driving end portion 26 opposite the first end portion thereof. The exemplary shank has a circular cross-section, but other embodiments thereof may have other cross-sectional configurations, for example a polygonal cross-sectional shape.

The shank preferably comprises a gripping portion for improving the gripping characteristic of the holding tool to facilitating handling thereof by users. In the exemplary embodiment, the gripping portion is in the form of a plurality of spaced apart annular grooves 28, only some of which are identified with reference numerals, disposed about a portion of shank between the first and driving end portions thereof. In the exemplary embodiment, the plurality of grooves are located more toward the driving end portion 26 of the tool. In other alternative embodiments, the gripping portion of the tool comprises a knurled or other textured surface formed on the shank of the fastener holding tool.

The exemplary driving end portion 26 of the shank and more particularly the end 27 thereof is intended for being impacted with a hammering tool for imparting an axial force to a fastener axially aligned with the first end portion 24 of the shank as discussed further below. In other embodiments, the shank may have other configurations. In some applications, for example, it may not be necessary to impact the shank with a hammering tool, and thus the shank may be formed of a material that is less hard than steel and the driving end portion thereof may be configured to more comfortably accommodate a user's hand, which applies the axial force thereto instead of the hammering tool.

In the exemplary embodiment, the shank 22 is formed of a hardened metal material, for example a carbon steel. The exemplary shank is approximately 10.25 inches in axial length and has a diameter of approximately 0.688 inches. These dimension however are not intended to be limiting, and other embodiments may have other dimensions more or less.

Figure 2:
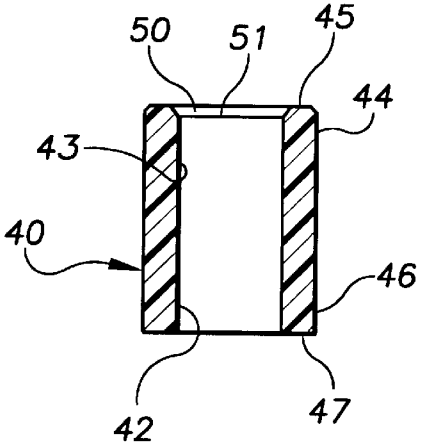
FIG. 2 is a sectional view of an exemplary resilient retainer for a holding tool.

In FIG. 1, the fastener holding tool 20 also comprises a resilient retainer 40 coupled generally to the first end portion 24 of the shank 22. In FIG. 2, the unassembled resilient retainer 40 comprises a first end portion 44 with a first end 45, and an axial bore 42 through at least the first end 45 defining an inner bore surface on the first end portion thereof. The resilient retainer 40 also comprises generally a second end portion 46 that is coupled to the shank 22 as discussed further below.

Figure 3:
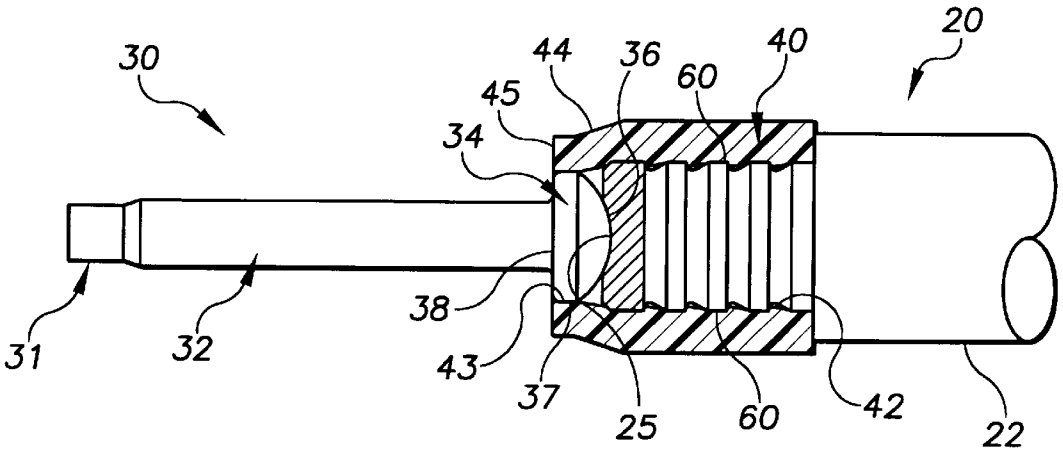
FIG. 3 is an enlarged view of an exemplary fastener and a portion of a fastener holding tool according to an exemplary configuration of the invention.
Figure 4:
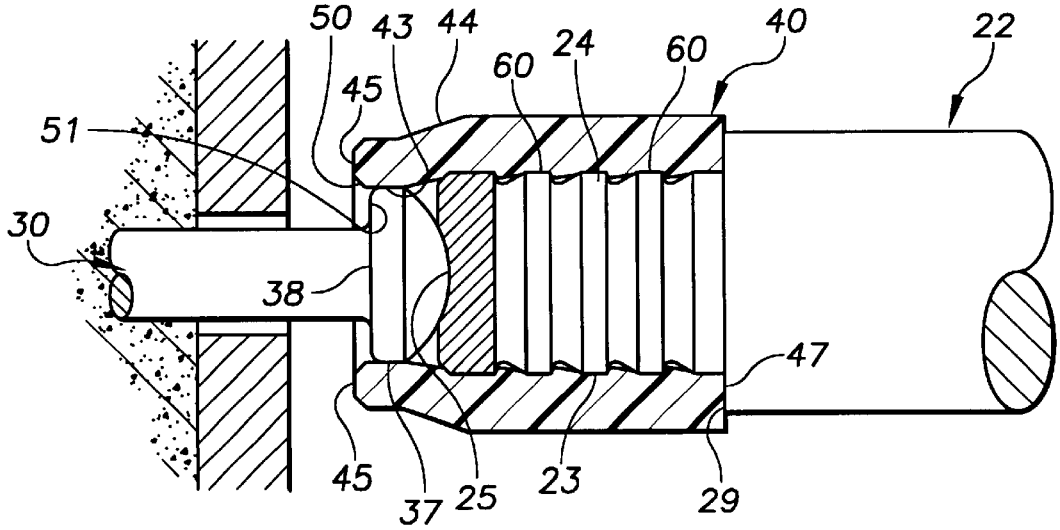
FIG. 4 is a partial sectional view of the another exemplary fastener driving system before the fastener is fully set into a workpiece.

When the resilient retainer 40 is coupled to the shank 22, as illustrated in FIGS. 3 and 4, the first end 45 of the resilient retainer 40 generally protrudes axially beyond a first end 25 of the shank. An inner surface portion 43 of the resilient retainer bore protruding axially beyond the first end 25 of the shank has a retainer bore diameter, which is sized for engaging and retaining a fastener therein as discussed further below.

The resilient retainer 40 is formed of a resilient material, for example a resilient polymer or other suitable material. In the exemplary embodiment, the bore diameter of the retainer member is constant, except for a chamfer or beveled portion that may be formed thereon in some embodiments discussed below. In one embodiment, the retainer bore diameter is between approximately 0.400 inches and approximately 0.410 inches. These dimensions however are not intended to be limiting and may be more or less in other embodiments.

Figure 5:
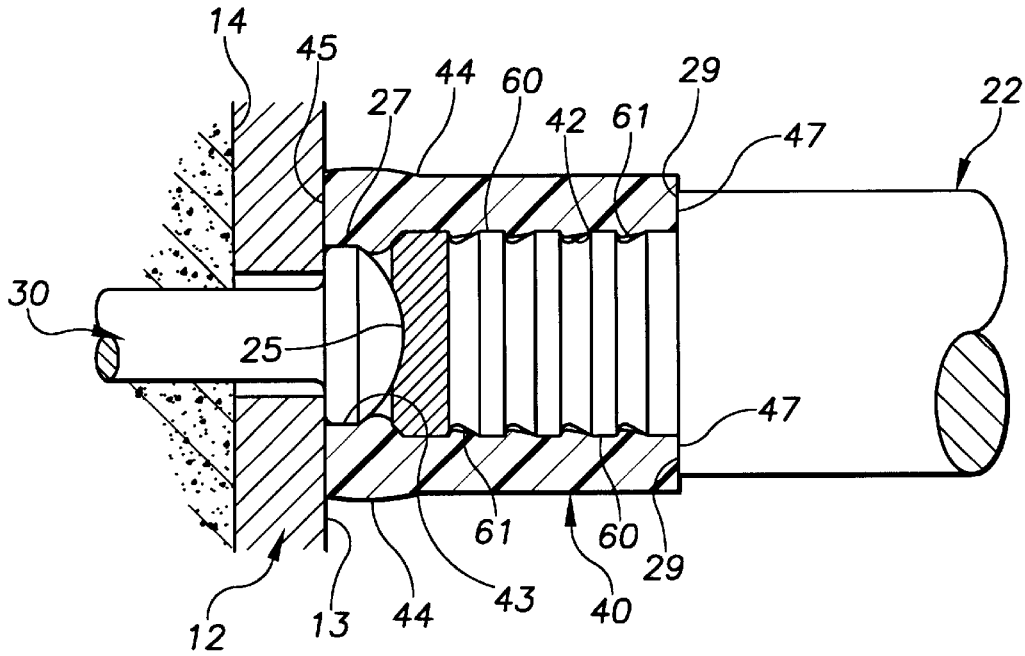
FIG. 5 is another partial sectional view of the exemplary fastener driving system after the fastener is fully set into the workpiece.

In FIG. 1, the exemplary fastener 30 is a concrete anchor configured for the exemplary application of fastening an electrical box 12 or other fixture to a concrete surface 14. The concrete anchor has generally an enlarged head diameter relative to the shaft diameter thereof for clamping against the fixture, as illustrated in FIG. 5. In FIG. 1, a tip portion of the fastener 30 is configured for disposal into a pre-drilled hole 16 formed in the concrete.

In FIG. 3, the exemplary fastener 30 comprises generally a shaft 32 with a head 34 disposed on a trailing end portion thereof. The fastener head 34 has an axial dimension between a top end 36 and a bottom end 38 thereof spaced axially from the top end. In the exemplary embodiment, the head diameter is greater than the shaft diameter. The head of the exemplary fastener 30 also has a cylindrical side wall 37, and the end 36 thereof has a general dome shape, sometimes referred to as a mushroom head. The tip portion 31 of the exemplary fastener 30 has a reduced diameter relative to the shaft diameter and a blunt end, which is suitable for anchoring in pre-drilled concrete holes.

In one exemplary embodiment, the head diameter of the fastener 30 is between approximately 0.435 inches and approximately 0.44 inches, the axial dimension of the fastener head, between the top and bottom ends thereof, is between approximately 0.140 inches and approximately 0.160 inches, and the axial dimension of the cylindrical side wall 37 is between approximately 0.073 inches and approximately 0.083 inches. These exemplary dimensions are not intended to limit the invention and in other embodiments may be more or less. The axial length of the fastener shaft and the configuration of the tip portion thereof are dependent generally on the particular application requirements.

The exemplary fastener 30 is known in trade as a REDI-DRIVE fastener and is available commercially in various sizes from ITW Ramset/Red Head, Wood Dale, Ill.

In other embodiments, the fastener may have other configurations and may be used for other applications. The fastener may be configured for fastening to materials other than concrete, for example to wood. Such a fastener may be alternatively configured with a pointed tip for penetration into the workpiece and/or may have a head that is configured differently, for example with a relatively narrow diameter as is typical of finishing nails. The fastener may also be embodied in other forms typical of tacks and other known fasteners.

According to the invention, the head diameter of the fastener is generally greater than the retainer bore diameter of the portion of the resilient retainer protruding axially beyond the first end of the shank. Thus configured, the resilient retainer engages and retains the fastener head in the holding tool in axial alignment with the shank thereof.

In the exemplary embodiment, the head diameter of the fastener is between approximately 0.435 inches and approximately 0.445 inches, and the resilient retainer bore diameter is between approximately 0.400 inches and approximately 0.410 inches. The relation between these dimensions, expressed for example as a range of ratios, is not intended to be limiting, since the relative sizes between the retainer bore diameter and the fastener head diameter may be more or less, so long as the fastener is retainable by the resilient retainer.

In operation, the fastener head 34 is disposed into the bore of the resilient retainer 40 until the top end 36 of the fastener head engages the first end 25 of the shank. Generally, the first end of the shank has a fastener head accommodating configuration, which helps axially align the fastener therewith. In the embodiments of FIGS. 3–5, the first end of the shank has a generally concave surface 25, and the top end 36 of the fastener head has a generally convex surface. With this configuration, the radius of curvature of the fastener head is preferably the same as or less than the radius of the first end of the shank. In other embodiments, the top end of the fastener head and the first end of the shank may have other configurations, for example relatively flat surfaces.

In one embodiment of the invention, clamping or pinching the first end portion of the resilient retainer between the fastener head and the work surface upon installation of the fastener is reduced or eliminated by reducing the extent that the first end of the resilient retainer protrudes beyond the bottom end of the fastener head disposed therein.

According to one embodiment of the invention, the axial dimension of the fastener head is not substantially less than, and is preferably about the same as, an axial dimension between the first end of the shank and the first end of the resilient retainer. In some other embodiments it is possible for the axial length of the fastener head to be greater than the axial dimension between the first end of the shank and the first end of the resilient retainer. This latter alternative configuration is possible so long as there is a sufficient side wall portion on the fastener head to be engaged and retained by the resilient retainer.

In FIG. 3, the axial dimension of the fastener head is approximately the same as the axial dimension between the first end 25 of the shank and the first end 45 of the resilient retainer prior to installation. The bottom end 38 of the fastener head is in substantial alignment with the first end 45 of the resilient retainer when the top end 36 of the fastener head abuts against the first end 25 of the holding tool shank. Thus configured, the first end portion of the resilient retainer cannot become clamped between the fastener head and the work surface.

According to another embodiment of the invention, the axial dimension of the fastener head is less than the axial dimension between the first end of the shank and the first end of the resilient retainer. FIG. 4 illustrates more particularly the first end 45 of the resilient retainer protruding axially beyond the bottom end 38 of the fastener head. In this alternative embodiment, an annular chamfer 50 is disposed on the resilient retainer 40 between the first end 45 of the resilient retainer and the retainer bore, or inner surface 43 thereof, also illustrated in FIG. 2. In FIGS. 4 and 5, a non-chamfered portion of the inner surface 43 of the resilient retainer also protrudes axially beyond the first end 25 of the shank and engages the cylindrical side portion 37 of the fastener. Portions of the chamfer may also engage the fastener head.

In FIG. 5, upon driving the fastener 30 through the work surface 14, the first end 45 of the resilient retainer 40 eventually engages the outer surface 13 of the fixture 12, thereby axially compressing and radially outwardly expanding the resilient retainer, particularly the first end portion 44 thereof, until the fastener is clamped against the surface 13. The chamfer 50 thus prevents the first end portion of the resilient retainer from becoming clamped or pinched between the fastener head and the work surface, as illustrated in FIG. 5.

In embodiments where a chamfered first end portion of the resilient retainer protrudes axially beyond the bottom end of the fastener head, the axial dimension of the fastener head may thus be less than the axial dimension between the first end 25 of the shank and the first end 45 of the resilient retainer. Generally, the greater the extent that the first end portion 44 of the resilient retainer extends beyond the bottom end 38 of the fastener head, the more chamfer that is required to prevent clamping of the resilient retainer between the fastener head and the work surface. In FIG. 4, the bottom end 38 of the fastener head is substantially aligned with an intersection 51 of the chamfer 50 and the retainer bore portion 43, whereby the inner bore surface 43 engages and retains the cylindrical side wall 37 of the fastener.

In FIG. 2, the second end portion 46 of the resilient retainer 40 has a second end 47, and the bore 42 of the resilient retainer extends through the second end 47 thereof. In the exemplary embodiment of FIG. 4, the first end portion 24 of the shank 22 is disposed into the bore 42 of the resilient retainer 40 from the second end 47 thereof. A portion 23 of the first end portion 24 of the shank has a first shank diameter, and at least a portion of the bore 42 of the resilient retainer 40 has a retainer bore diameter that is less than the first shank diameter of the shank portion 23. The shank portion 23 having the first shank diameter is thus frictionally engaged with the relatively small diameter retainer bore 42 to retain the resilient retainer 40 on the first end portion of the shank.

FIG. 5 illustrates a shoulder 29 disposed about the first end portion of the shank 22. The second end 47 of the resilient retainer 40 is engagable with the shoulder 29 of the shank to prevent axial displacement of the second end of the resilient retainer relative to the shank 22 during installation of the fastener. In the exemplary embodiments of FIGS. 4 and 5, during installation of the fastener, the resilient retainer 40 is compressed between the shank shoulder 29 and the fixture surface 13 during deformation of the resilient retainer, as discussed.

The shank shoulder 29 also prevents axial migration of the resilient retainer 40 relative to the shank 22 when the fastener head is initially disposed into the bore 43 of the resilient retainer prior to installation of the fastener. Thus the shoulder 29 is also useful in embodiments of the type illustrated in FIG. 3 where there is little or no compression of the resilient retainer 40 during installation of the fastener. In other embodiments, however, other means may be used to fix the resilient retainer on the shank.

A retainer engagement member is preferably disposed about the first end portion of the shank, and more particularly about the portion thereof disposed in the bore of the resilient retainer so that the retainer engagement member is securely engaged with the inner retainer bore surface. In FIGS. 3–5, one or more annular ribs 60 are disposed about the first end portion of the shank 22, only some of which are referenced with numerals. The plurality of annular ribs are disposed in the bore 42 of the resilient retainer 40 and engaged with the inner surface thereof. FIG. 5 illustrates the annular ribs 60 have a tapered side 61 to facilitate assembly of the resilient retainer 40 about the first end portion of the shank.

While the foregoing written description of the invention enables one of ordinary skill to make and use what is considered presently to be the best mode thereof, those of ordinary skill will understand and appreciate the existence of variations, combinations, and equivalents of the specific exemplary embodiments herein. The invention is therefore to be limited not by the exemplary embodiments herein, but by all embodiments within the scope and spirit of the appended claims.

What is claimed is:

1. An axial impact fastener holding tool comprising:

a shank having a first end portion with a first end and an opposite driving end portion, a portion of the first end portion having a first shank diameter, the shank having an annular shoulder disposed about the first end portion thereof and a plurality of annular ribs disposed about the first end portion;

a resilient retainer having a first end portion with a first end and a second end portion with a second end, the resilient retainer having a bore through the first and second ends thereof at least a portion of the bore having a retainer bore diameter less than the shank first end portion diameter prior to insertion of the shank therein, the first end portion of the shank being disposed in the bore at the second end of the resilient retainer and engaged therewith;

the bore having an annular chamfer at the first end portion of the resilient retainer, the second end portion of the resilient retainer coupled to the first end portion of the shank and fixed relative thereto, the second end of the resilient retainer abutting the shoulder at the first end portion of the shank, the shank ribs disposed in and engaged with the resilient retainer, the first end of the resilient retainer and a non-chamfered portion of the bore thereof protruding axially beyond the first end of the shank.

2. The tool of claim 1, the first end of the shank having a fastener head accommodating configuration.

3. An axial impact fastener driving system comprising:

a fastener holding tool having a shank with a first end portion and a driving end portion opposite the first end portion thereof, the first end portion of the shank having a first end having a generally concave surface;

the fastener holding tool having a resilient retainer with a bore therethrough, the resilient retainer coupled to the first end portion of the shank, the resilient retainer having a first end portion with a first end, the first end of the resilient retainer protruding axially beyond the first end of the shank, a portion of the resilient retainer bore protruding axially beyond the first end of the shank having a retainer bore diameter;

a fastener having a shaft with a head formed on a trailing end portion thereof, the fastener head having an axial dimension and a head diameter the head having a top end having a generally convex surface, the axial dimension of the fastener head being not less than the axial dimension between the first end of the shank and the first end of the resilient retainer, the head diameter being greater than the retainer bore diameter prior to insertion of the fastener head into the bore from the first end of the resilient retainer, whereby the fastener is retained by the resilient retainer upon insertion of the fastener head into the bore of the resilient retainer.

4. The system of claim 3, the axial dimension of the fastener head being greater than the axial dimension between the first end of the shank and the first end of the resilient retainer.

5. The system of claim 3, the fastener head having a cylindrical side portion.

6. The system of claim 3 the resilient retainer having a second end portion with a second end, the bore of the resilient retainer extending through the second end thereof, the first end portion of the shank having a first shank diameter, the first end of the shank being disposed in the bore at the second end of the resilient retainer, at least a portion of the bore of the resilient retainer having a retainer bore diameter less than the first shank diameter prior to the insertion of the first end portion of the shank therein, the second end of the resilient retainer fixed axially relative to the shank.

7. The system of claim 6, a retainer engagement member disposed about the first end portion of the shank, the retainer engagement member of the shank disposed in the bore of the resilient retainer from the second end of the resilient retainer and engaged with the bore thereof.

8. The system of claim 6, an annular rib disposed about the first end portion of the shank and formed unitarily therewith, the annular rib disposed in the bore of the resilient retainer and engaged therewith.

9. The system of claim 6, an annular shoulder disposed about the first end portion of the shank, the second end of the resilient retainer abuts against the shoulder of the shank.

10. The system of claim 3, the head diameter of the fastener being greater than a shaft diameter thereof, the fastener head having a cylindrical side portion.

* * * * *